US008596238B2

(12) United States Patent
Werler et al.

(10) Patent No.: US 8,596,238 B2
(45) Date of Patent: Dec. 3, 2013

(54) VALVE TRAIN FOR INTERNAL COMBUSTION ENGINES FOR ACTUATING GAS EXCHANGE VALVES

(75) Inventors: Andreas Werler, Zwickau (DE); Thomas Arnold, Stollberg (DE); Heiko Neukirchner, Chemnitz (DE); Joerg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 118 days.

(21) Appl. No.: 13/387,752

(22) PCT Filed: Aug. 3, 2010

(86) PCT No.: PCT/DE2010/000930
§ 371 (c)(1),
(2), (4) Date: Jan. 30, 2012

(87) PCT Pub. No.: WO2011/018073
PCT Pub. Date: Feb. 17, 2011

(65) Prior Publication Data

US 2012/0125273 A1 May 24, 2012

(30) Foreign Application Priority Data

Aug. 10, 2009 (DE) ..... 10 2009 037 269

(51) Int. Cl.
*F01L 1/04* (2006.01)

(52) U.S. Cl.
USPC ..... 123/90.6; 123/90.16; 123/90.31; 29/888.1

(58) Field of Classification Search
USPC ..... 123/90.16, 90.31, 90.6; 29/888.1
See application file for complete search history.

(56) References Cited

U.S. PATENT DOCUMENTS

| | | | | |
|---|---|---|---|---|
| 3,481,314 | A | 12/1969 | Lecrenn | |
| 5,289,806 | A | 3/1994 | Hurr | |
| 5,509,384 | A | 4/1996 | Schmid | |
| 6,382,149 | B1 | 5/2002 | Fischer et al. | |
| 8,230,833 | B2 * | 7/2012 | Werler et al. | 123/90.6 |
| 2010/0242884 | A1 | 9/2010 | Meintschel et al. | |
| 2012/0037106 | A1 | 2/2012 | Werler et al. | |

FOREIGN PATENT DOCUMENTS

| | | | |
|---|---|---|---|
| DE | 3934848 | A1 | 4/1991 |
| DE | 4230877 | A1 | 4/1993 |
| DE | 4331977 | A1 | 3/1995 |
| DE | 4416505 | A1 | 11/1995 |
| DE | 19520117 | A1 | 12/1996 |

(Continued)

*Primary Examiner* — Ching Chang
(74) *Attorney, Agent, or Firm* — Leydig, Voit & Mayer, Ltd.

(57) ABSTRACT

A valve train includes a a plurality of individual cam sleeves axially displaceable relative to one another and disposed so as to form the camshaft, each of the plurality of individual cam sleeves including a plurality of different cam profiles each having a same base circle portion and being configured to engage, by switching, one of a plurality of gas exchange valves. A switching shaft is disposed inside the plurality of cam sleeves and configured to rotate together with the plurality of cam sleeves. An encircling switching contour is disposed inside each of the plurality of cam sleeves. A switching pin operatively connects one of the plurality of cam sleeves to the switching shaft, the switching pin configured to slide in the encircling switching contour. An actuator is operatively connected to the switching shaft so as to rotate the switching shaft relative to the plurality of cam sleeves.

6 Claims, 1 Drawing Sheet

(56) References Cited

FOREIGN PATENT DOCUMENTS

| | | | |
|---|---|---|---|
| DE | 19825307 | A1 | 12/1999 |
| DE | 10054623 | A1 | 5/2002 |
| DE | 102007016977 | A1 | 10/2008 |
| DE | 102007027979 | A1 | 1/2009 |
| DE | 102007054978 | A1 | 5/2009 |
| DE | 102009037268 | B3 | 4/2011 |
| DE | 102009037270 | B4 | 4/2011 |
| DE | 102009017242 | B4 | 9/2011 |
| EP | 0579592 | A1 | 1/1994 |

* cited by examiner

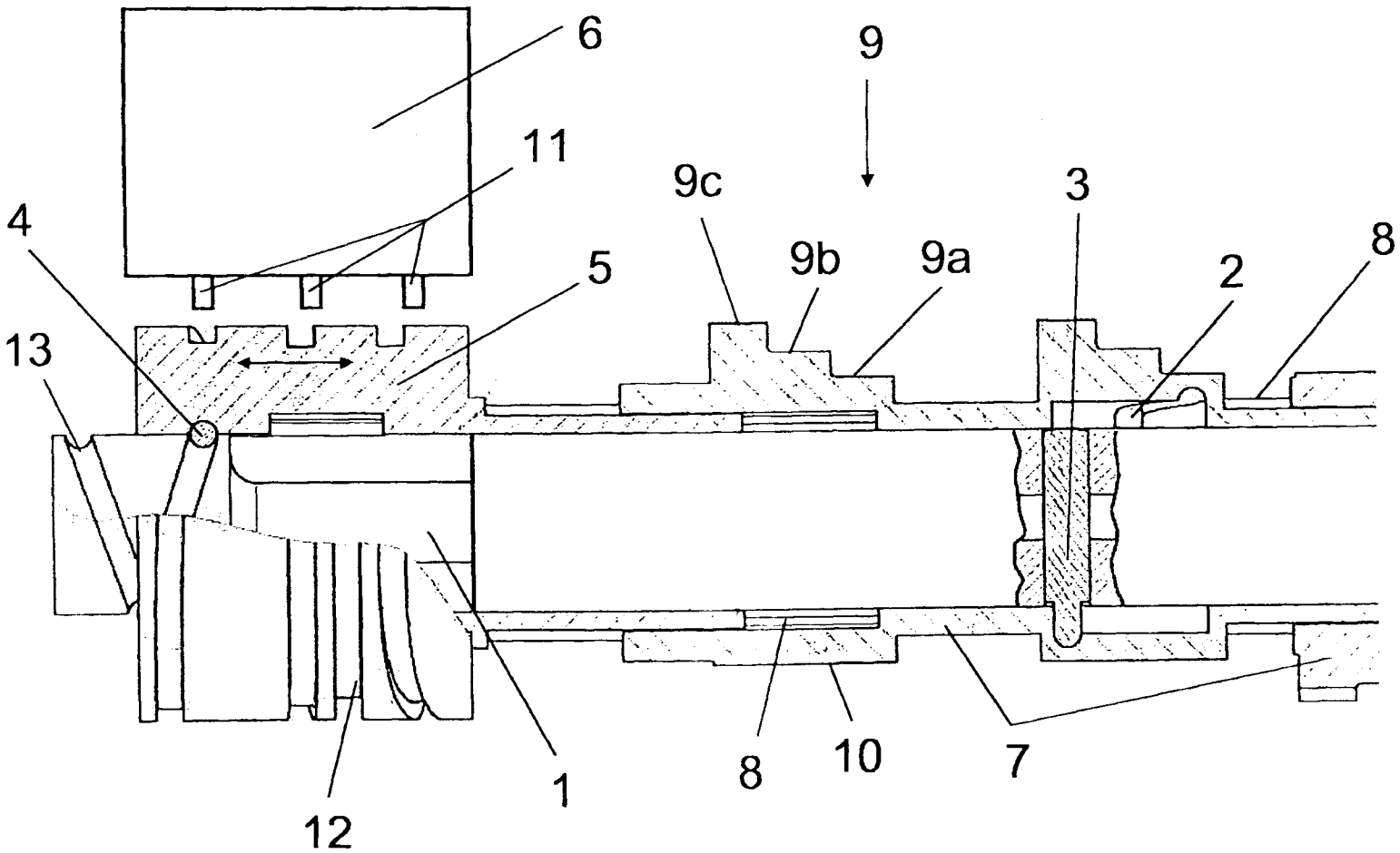
8
2
3
9
9a
9b
9c
6
11
5
4
13
7
10
8
1
12

VALVE TRAIN FOR INTERNAL COMBUSTION ENGINES FOR ACTUATING GAS EXCHANGE VALVES

CROSS-REFERENCE TO PRIOR APPLICATIONS

This application is a U.S. National Phase application under 35 U.S.C. §371 of International Application No. PCT/DE2010/000930, filed on Aug. 3, 2010, and claims benefit to German Patent Application No. DE 10 2009 037 269.5, filed on Aug. 10, 2009. The International Application was published in German on Feb. 17, 2011 as WO 2011/018073 under PCT Article 21(2).

FIELD

The invention relates to a valve train for internal combustion engines for actuating gas exchange valves.

Gas exchange valves of an internal combustion engine can be operated in a variable manner, with different opening and closing times and with different valve opening lifts. A valve control system of this type is previously described in DE 42 30 877 A1. In this document, a cam support having two different cam contours is arranged so as to be rotationally engaged but axially displaceable on a camshaft. Depending on the axial position of the cam support, one cam contour is operatively connected to the lift valve via an intermediate member (transmission lever). During the base circle phase, the cam support is axially displaced by means of a thrust collar, counter to the action of a pull-back spring, to change the valve parameters.

A drawback in this instance is the large amount of space required for adjusting the cam support. These solutions can therefore only be used with relatively large cylinder spacings, in such a way that the relevant components can be accommodated. A further drawback is the high inertial forces during the adjustment process which are required for displacing the cam support or the adjustment members. It is only possible to switch to a corresponding cam contour in a cylinder-selective manner. Valve-selective switching is not possible.

DE 100 54 623 A1 describes a device for switching a cam support on a camshaft for actuating gas exchange valves, in which the cam support is guided in axial displacement on the camshaft. The gas exchange valve is operatively connected to different cam contours depending on the position of the cam support. The cam support is adjusted via an adjustment element in cooperation with a slide path. In this instance the adjustment element is a radially outwardly displaceable pin, which when extended cooperates with at least two slide paths formed in a guide part arranged through approximately 180° around the cam support.

A drawback of this solution, in addition to the additional space for the guide part, is that to switch to a different cam contour, the pin has to be extended from the camshaft and slid into an axially displaceable switch slide. After the switching process, the pin has to be retracted again. This construction has high parts and manufacturing requirements, and there is a risk of damage to the camshaft as a result of incorrect switching of the pin. A further drawback is that the necessary adjustment time of the pin restricts the rotational speed of the motor. In addition, the adjustment is dependent on the oil pressure provided in each case.

Further, a valve train of an internal combustion engine is previously described in DE 195 20 117 C2, in which an axially displaceable cam support having at least two different cam paths is arranged rotationally engaged on the camshaft. The cam support is adjusted by means of an adjustment member, which is guided inside the camshaft. A double-action hydraulic or pneumatic piston cylinder unit, arranged on an end face of the camshaft, displaces the undulating adjustment member inside the camshaft counter to the compression of a spring. The adjustment member is connected to an entrainment piece, which penetrates through a slot arranged axially in the camshaft and extends into a hole in the cam support.

The drawback of this solution is that by axially displacing the adjustment member, it is only possible to displace a plurality of cam supports arranged on the camshaft simultaneously. Different switching of individual cam supports on a camshaft is not possible. A further drawback is that in a switching position in which an external cam is engaged in the gas exchange valve, the spring element is constantly under tension. This results in high lateral frictional forces between the entrainment piece and the guide path arranged on the adjustment member. This leads to increased wear and possible related incorrect switchings. A further drawback is that the acting spring forces have to be adjusted precisely so as to prevent incorrect switchings, in particular when switching back to the central cam profile if there are three different cam profiles.

DE 10 2009 017 242, held by the Applicant, describes a valve train for actuating gas exchange valves of internal combustion engines. In the valve train, the cam support is displaced on the camshaft tube, for valve switching, by a switching shaft rotatably arranged inside the camshaft tube. The switching shaft is provided with a switching contour having an axial inclination. A switching ball, which is mounted in a hole of an axially displaceable switching sleeve which encircles the switching shaft, is guided in the switching contour. The switching sleeve is operatively connected to the cam support via a dog. When the switching shaft is rotated, the switching sleeve is axially displaced via the switching ball and the cam support is axially displaced via the dog.

The arrangement of a switching sleeve between the switching shaft and the camshaft tube leads to frictional forces which additionally have to be overcome. Moreover, the solution by way of the switching sleeve arrangement has high parts requirements.

SUMMARY OF THE INVENTION

In an embodiment, the present invention provides a valve train for actuating a plurality of gas exchange valves of an internal combustion engine, wherein a crankshaft of the internal combustion engine drives a camshaft. A plurality of individual cam sleeves is axially displaceable relative to one another and is disposed so as to form the camshaft. Each of the plurality of individual cam sleeves includes a plurality of different cam profiles each having a same base circle portion, the plurality of different cam profiles being configured to engage, by switching, one of the plurality of gas exchange valves. A switching shaft is disposed inside the plurality of cam sleeves and is configured to rotate together with the plurality of cam sleeves. An encircling switching contour is disposed inside each of the plurality of cam sleeves. A switching pin operatively connects one of the plurality of cam sleeves to the switching shaft, the switching pin configured to slide in the encircling switching contour. An actuator is operatively connected to the switching shaft so as to rotate the switching shaft relative to the plurality of cam sleeves.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

The single FIGURE shows a sub-region of a valve train of an internal combustion engine.

DETAILED DESCRIPTION

The invention provides a valve train for actuating gas exchange valves of internal combustion engines which is distinguished by a simplified construction together with a reduction in the frictional forces.

In an embodiment, the valve train according to the invention for internal combustion engines for actuating the gas exchange valves consists of a camshaft which is driven by a crankshaft of the internal combustion engine and which consists of a plurality of individual cam sleeves which are axially displaceable relative to one another. The cam sleeves which are axially displaceable relative to one another are interconnected via an axially extending toothing, the toothings of the respectively adjacent cam sleeves being formed so as to mesh. A plurality of different cam profiles having the same base circle portion are arranged on each cam sleeve, and can be engaged with the gas exchange valves by displacing the individual cam sleeves. A switching shaft is arranged inside the cam sleeves, rotates together with the cam sleeves, and is operatively connected to the respective cam sleeve via a switching pin in each case. A switching contour, in which the dog is slidingly mounted, is arranged on the inner circumference of each cam sleeve. The switching shaft is connected to an actuator which triggers a rotation of the switching shaft relative to the cam sleeves during a switching process so as to displace the cam sleeves.

The advantage of the solution according to the invention is a simple construction of the actuation device for reliably switching valves between different cam profiles of the camshaft, in which the friction between the individual components is also reduced.

The drawing shows a sub-region of a valve train of an internal combustion engine. The valve train for actuating gas exchange valves consists of a camshaft, which is driven by a crankshaft of the internal combustion machine and consists of a plurality of cam sleeves 7 which are axially displaceable relative to one another. An axially displaceable cam sleeve 7 is associated with each cylinder of a multi-cylinder internal combustion engine, and according to the embodiment, two gas exchange valves of a cylinder can be actuated by each cam sleeve 7 by way of the two cam profiles 9 arranged thereon. The cam sleeve 7 has a plurality of differently formed cam profiles 9*a*, 9*b* and 9*c* having an identical base circle portion 10, which for valve lift switching are each selectively brought into contact with a respective gas exchange valve, directly or via intermediate members, by displacing the cam sleeve 7. In the embodiment shown, each cam sleeve 7 has two cam profiles 9, each having a small cam profile 9*a*, a medium cam profile 9*b* and a large cam profile 9*c* for actuating the two gas exchange valves. It is perfectly conceivable for the cam profiles 9 of each cam sleeve 7 to consist of only two or more than three differently sized cam profiles. To achieve a phase shift between the different cam profiles 9*a*, 9*b* and 9*c*, the curves of the cam profiles 9*a*, 9*b* and 9*c* may be arranged mutually offset.

The individual cam sleeves 7 which are axially displaceable relative to one another are interconnected by an axially extending toothing 8. The cam sleeves 7 are thus formed in such a way that the toothing 8 of respectively adjacent cam sleeves 7 meshes. This is provided in that the individual cam sleeves 7 are axially displaceable and rotationally engaged relative to one another. A switching shaft 1 is arranged inside the cam sleeves 7 and apart from during the switching process rotates synchronously with the cam sleeve 7. Each cam sleeve 7 is operatively connected to the switching shaft via a switching pin 3. The switching pin 3 is rigidly connected to the switching shaft 1 and mounted slidingly in an encircling switching contour 2 arranged on the inner circumference of the cam sleeves 7. The encircling switching contour 2 arranged on the inner circumference of the cam sleeves 7 has a plurality of different axial inclinations. If the individual cam sleeves 7 are to be axially displaced in succession, the individual axial inclinations of the switching contours 2 arranged for the respective cam sleeves 7 are arranged mutually offset on the inner circumference of the cam sleeves 7. If the individual cam sleeves 7 are to be axially displaced simultaneously, the individual axial inclinations of the switching contours 2 arranged for the respective cam sleeves 7 are positioned in the same axial plane on the inner circumference of the cam sleeves 7.

The switching shaft 1 is operatively connected to an actuator 6 so as to rotate the switching shaft 1 relative to the cam sleeves 7. The actuator 6 may be connected to the switching shaft 1 directly or via a cam transmission as shown in the drawings. The cam transmission consists of a switching contour 13 which is arranged on the circumference of the switching shaft 1, a switching ball 4 being slidingly mounted in said switching shaft and in turn being mounted in a hemispherical recess arranged on the inner circumference of a displacement piece 5. The displacement piece 5 is connected to a cam sleeve 7 so as to be rotationally engaged but axially displaceable. In this context, the cam sleeve 7 and the displacement piece 5 are connected via a meshing axial toothing. The displacement piece 5 can be operatively connected to an actuator 6 which is rigidly connected to a housing of the internal combustion engine. Thus, when the actuator 6 is actuated, a pin 11 arranged on the actuator 6 engages in the contour 12 arranged on the circumference of the displacement piece 5. The displacement piece 5 is axially displaceable in both directions relative to a cam sleeve 7, as shown by the double-headed arrow in the drawing.

The variable valve drive operates as follows to provide switching between the different cam profiles 9*a*, 9*b* and 9*c*.

While the central cam profile 9*b* of the cam sleeve 7 is engaged with the gas exchange valve, for example, the cam sleeve 7, the switching shaft 1 and the displacement piece 5 rotate at a synchronous rotational speed. The actuator 6 is not engaged with the displacement piece 5. It is only possible to switch to another cam profile when the base circle portion 10 is engaged with the gas exchange valve or the intermediate member. To switch the engagement of the cam profile 9*b* on the gas exchange valve to the cam profile 9*a* or the cam profile 9*c*, the actuator 6 is activated by an appropriate actuation and brought into engagement with the displacement piece 5. In the disclosed embodiment, this is provided in that a pin 11 is extended towards the displacement piece 5 and latches into the contour 12 arranged on the circumference of the displacement piece 5. Depending on the actuated pin 11, the displacement piece 5 is axially displaced to the right or to the left relative to the cam sleeve 7, in accordance with the switching process to be carried out, by the pin 11, which slides in the contour 12. The axial movement of the displacement piece 5 is transformed into a rotation of the switching shaft 1 via the switching ball 4 which slides in the switching contour 13. This results in rotation of the switching shaft 1 relative to the cam sleeves 7. The relative rotation causes the hemispherical part of the switching pin 3 to slide in the path of the encircling switching contour 2 of the cam sleeve 7. Based on the relative rotation and the individual switching contours 2 which are operatively connected to each cam sleeve 7 via the switching balls 3, the cam sleeves 7 are axially displaced relative to one another, resulting in switching between the individual cam profiles 9*a*, 9*b* and 9*c*.

The displacement piece 5 may also for example be displaced by an actuator which acts magnetically on the displacement piece 5.

The advantage of the solution according to the invention is a small, simple construction of the valve train, with which valve switchings variably adapted to the motor are possible.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 switching shaft
2 switching contour
3 switching pin
4 switching ball
5 displacement piece
6 actuator
7 cam sleeve
8 toothing
9 cam profile
9*a* small cam profile
9*b* medium cam profile
9*c* large cam profile
10 base circle portion
11 pin
12 contour
13 switching contour

The invention claimed is:

1. A valve train for actuating a plurality of gas exchange valves of an internal combustion engine, wherein a crankshaft of the internal combustion engine drives a camshaft, the valve train comprising:

a plurality of individual cam sleeves axially displaceable relative to one another and disposed so as to form the camshaft, each of the plurality of individual cam sleeves including a plurality of different cam profiles each having a same base circle portion, the plurality of different cam profiles being configured to engage, by switching, one of the plurality of gas exchange valves;

a switching shaft disposed inside the plurality of cam sleeves and configured to rotate together with the plurality of cam sleeves;

an encircling switching contour disposed inside each of the plurality of cam sleeves;

a switching pin operatively connecting one of the plurality of cam sleeves to the switching shaft, the switching pin configured to slide in the encircling switching contour; and an actuator operatively connected to the switching shaft so as to rotate the switching shaft relative to the plurality of cam sleeves.

2. The valve train as recited in claim 1, wherein each of the plurality of cam sleeves include an axially extending toothing configured to interconnect one of the plurality of cam sleeves to an adjacent one of the plurality of cam sleeves with the axially extending toothing of the one of the plurality of cam sleeves forming a mesh with the axially extending toothing of the adjacent one of the plurality of cam sleeves.

3. The valve train as recited in claim 1, wherein each of the encircling switching contours include a plurality of axial inclinations differing from one another.

4. The valve train as recited in claim 3, wherein the plurality of axial inclinations are disposed mutually offset on an inner circumference of the plurality of cam sleeves to as to axially displace each of the plurality of cam sleeves in sucession.

5. The valve train as recited in claim 3, wherein the plurality of axial inclinations are disposed in a same axial plane on an inner circumference of the plurality of cam sleeves to as to axially displace the plurality of cam sleeves simultaneously.

6. The valve train as recited in claim 1, further comprising a displacement piece connected to the switching shaft via a cam transmission and disposed so as to be rotationally engaged but axially displaceable relative to one of the plurality of cam sleeves.

* * * * *